US005780107A

United States Patent [19]

Carr et al.

[11] Patent Number: 5,780,107

[45] Date of Patent: Jul. 14, 1998

[54] WOOL PRE-TREATMENT METHOD

[75] Inventors: Christopher Michael Carr, Winsford; Kevin James Dodd, Crawcrook, both of United Kingdom

[73] Assignee: The University of Manchester Institute of Science and Technology, Manchester, United Kingdom

[21] Appl. No.: 750,931

[22] PCT Filed: Aug. 7, 1995

[86] PCT No.: PCT/GB95/01862

§ 371 Date: Jun. 16, 1997

§ 102(e) Date: Jun. 16, 1997

[87] PCT Pub. No.: WO96/05355

PCT Pub. Date: Feb. 22, 1996

[30] Foreign Application Priority Data

Aug. 9, 1994 [GB] United Kingdom ..... 9416032

[51] Int. Cl.[6] ..... B05D 1/00

[52] U.S. Cl. ..... 427/255.1; 427/255.5; 8/127.5; 8/127.51; 8/128.1; 8/149.2

[58] Field of Search ..... 8/128.1, 127.5, 8/127.51, 128.3, 149.2, 474; 427/248.1, 255.1, 255.5

[56] References Cited

U.S. PATENT DOCUMENTS 4,508,781 4/1985 Yagi et al. ..... 428/409

FOREIGN PATENT DOCUMENTS 4202845 7/1992 Japan .

578499 7/1946 United Kingdom .

OTHER PUBLICATIONS

Vol. 41, 1947 Chemical Abstracts, Columbus, Ohio, U.S.; R.F. Hudson et al.: "The action of fluorine and fluorides on wool" col. 1447; 1946.

May, 1946 Society of Dyers and Colourists "The Action of Fluorine and Fluorides on Wool" by R.F. Hudson and P. Alexander pp. 193–198 1946.

Landwehr, Textile Research Journal, Aug. 1969, pp. 792–793.

*Primary Examiner*—Erma Cameron

*Attorney, Agent, or Firm*—Woodard, Emhardt, Naughton, Moriarty & McNett

[57] ABSTRACT

A method for treating a fabric comprising fibres of keratin to impart shrink-resistance to the fabric by passing the fabric continuously through a chamber containing an atmosphere of 10% or less fluorine gas by volume at a rate such that the residence time of the fabric within the chamber is 60 seconds or less.

8 Claims, 5 Drawing Sheets

Dye exhaustion profile of Sandolan Milling Blue N-BL on wool fabric

Dye exhaustion profile of Sandolan Milling Blue N-BL on wool fabric

Dye exhaustion profile of Neutrichrome Navy M-BD on wool fabric

Dye exhaustion profile of Lanasol Blue 3G on wool fabric

Total fixation efficiency (T) vs dyeing time of Lanasol Blue 3G on wool fabric

Dye exhaustion profile of Sandolan Milling Blue N-BL on wool fabric in low-temperature dyeing

WOOL PRE-TREATMENT METHOD

The present invention relates to a method for prosing fabric incorporating fibres of keratin to impart shrink-resistance to the fabric. The term "fabrics" is used herein to mean any assembly of fibres such as woven wool, top (aligned fibres), web or yarn.

It is well known that keratin fibres such as wool have a tendency to shrink during laundering. The shrinkage of wool during laundering is a result of the surface cuticular structure of th fibre. It is known to overcome this problem by treating the wool to reduce or eliminate the "directional frictional effect". Shrink resistance can be achieved by making use of three basic approches:

Scale masking or surface coating;

Chemical or enzymic modification of the fibre surface,

Formation of inter-fibre bonds in the fabric to restrict movement of the fibres during laundering.

Chemical modification has been achieved in the past using a variety of processes but the most popular process relies upon chlorination. In particular it is well known to pass a fabric through a fluid including chlorine and subsequently to apply to, the chlorinated fabric a shrink proofing polymer. This approach is very effective and economic but as it is a "wet" finishing treatment some form of effluent processing is required It is becoming highly undesirable to have to dispose of absorbable organohalogens into the water supply and thus the traditional chlorination route is becoming less and less acceptable.

Corona discharge is a well known and widely used alternative to chlorination for achieving shrink resistance. This process involves the bombardment of the fabric surface with high energy electrons which are of sufficient energy to break covalent bonds in the fibres. In addition, collision between electrons and components of the air results in the formation of ozone and nitrogen oxide. Subsequent reaction between free valent species on the fibre surface and the corona atmosphere leads to the formation of a polar surface encouraging wetting and adhesion of subsequently applied polymer surface treatments. Amino acid analysis of cuticular protein indicates the formation of cysteic acid. Corona treatment has been shown to improve shrink resistance, yarn tensile properties, spinnability and wettability, and treated fabrics or yarns exhibit superior dyeing properties. Improvements in shrink resistance and spinnability have been attributed to an increase in fibre friction.

Thus electrical discharge does provide an alternative to conventional chlorination but unfortunately is economically unattractive as the process is relatively slow, reducing the maximum rate of production of treated fabric, and in addition cannot successfully treat fibres within bulky fabrics, e.g. wool top.

In 1946, Hudson and Alexander demonstrated that gaseous fluorination could be used to impart shrink resistance to wool. Subsequently a reference was made to their work in the general text book "R F Hudson and P Alexander, "Wool: Its Chemistry and Physics", Pub. Chapman and Hall, London, Sec. Ed., (1963)". The treatment times suggested by this work, however, indicated that a fabric to be treated had to be resident within a chamber containing fluorine gas for long periods, for example 20 minutes. Thus, fabric was treated in batches and continuous treatment of fabric was not possible. In addition, high concentrations of fluorine gas were required, for example 20% fluorine. Finally, it was stated that the wool had to be pre-dried before treatment. These requirements, particularly the required residence times and the required pre-drying, make it completely uneconomic to rely upon fluorination as described in the published documents.

It is an objective of the present invention to obviate or mitigate the problems outlined above.

According to the present invention, there is provided a method for pre-treating a fabric incorporating fibres of keratin to impart shrink-resistance to the fabric, wherein the fabric is passed continuously through a chamber containing an atmosphere of fluorine gas at a rate such that the residence time of the fabric within the chamber is 60 seconds or less.

Thus, in contrast with the published fluorination method, fabric is passed continuously through an atmosphere containing fluorine rather than being processed batch-wise. This is made possible because of the realisation that good shrink resistance can be imparted by exposing a woollen fabric to fluorine gas of relatively low concentration for a relatively short period of time. For example the residence time is preferably less than 60 seconds, for example less than 12 seconds. Good results have been achieved with residence times of less than 6 seconds, for example 4 seconds.

The atmosphere may contain 10% or less fluorine by volume, for example less than 5%. Good results have been achieved with an atmosphere containing 3% fluorine by volume.

The atmosphere may be a mixture of nitrogen and fluorine gases.

Preferably a polymer coating is applied to the fabric after fluorinisation to improve washability. The polymer is preferably an amino polysiloxane.

Embodiments of the present invention will now be described, by way of example, with reference to the following examples and the accompanying drawings in which:

Figure 1:
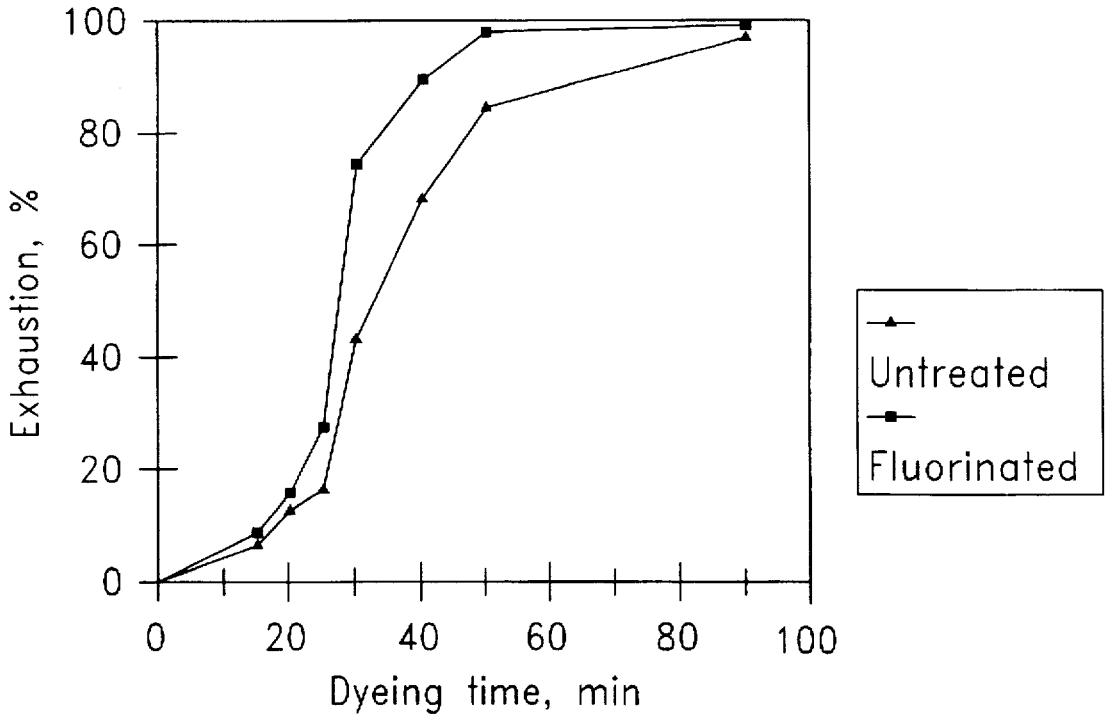
FIGS. 1–3 are graphs of dye exhaustion against dyeing time for various dyes on wool fabric untreated and treated according to the present invention.

The abbreviations used herein are terms recognized by persons skilled in the art and have the following meaning:

G-Shear stiffness of fabric

2HG-Shear hysteresis at 0.50°

2HG5-Shear hysteresis at 5.0°

B-Bending stiffness of the fabric

2HB-Bending hysteresis

Koshi-Primary handle value for fabric stiffness of the fabric

K/S-Colour yield o.w.f. on weight of fabric Yellowness-A value of the yellowness (colour) of the fabric Tests were conducted using a 100% wool botany serge of 190 g/m$^2$. Fabric shrinkage was assessed by taking fabric squares with a 20 cm edge, marking the squares with reference points approximately 3 cm from an edge, and then relaxing the fabric in water at a temperature below 40° C. for 45 minutes. The wet distances between the points were measured and the resulting area calculated to give a measure of the initial area. Wash tests were carried out using a Wascator FOM 71P machine with standard program 5A and including 4 g of detergent. Fabric shrinkage was determined after each wash cycle by measurement of the new fabric area and comparison of the new fabric area with the initial area.

The influence of the preparatory treatment on the mechanical properties of the fabric were assessed, both before and after an application of polymer to be described below using the Kawabata evaluation system for fabrics. The 20 cm square samples were conditioned at 65% relative huidity and at 20° C. prior to testing. Primary Hand Values (PHV) were calculated based on mens winter suiting. To provide comparative data, samples of fabric were not preteated. Other samples were chlorinated in a conventional manner using the standard BASF method. In addition, corona treatments were carried out on further samples at three levels of severity, that is 640 Wmin/m$^2$, 960 Wmin/m$^2$and 1280 Wmin/m$^2$.

Samples of fabric were exposed to 3% fluorine in a nitrogen atmosphere. The level of fluorination was dependent on exposure time, that is the time taken for the sample to be pulled through a chamber filled with the 3% fluorine gas. At a sample speed of 1 metre per minute the sample was in contact with the fluorine environment for 60 seconds. This condition is referred to below as high fluorination level. At a fabric speed of 5 metres per minute, the contact time was 12 seconds (medium fluorination). At a fabric speed of 10 metres per minute, the contact time was 6 seconds (medium/low fluorination). At a fabric speed of 15 metres per minute the fabric was in contact with the fluorine for 4 seconds (low fluorination level).

The influence of all the above pre-treatments on the mechanical properties of the fabric are illustrated in Table 1 below. Both fluorination and corona pretreatments significantly increased shear and bending moments and overall fabric stiffness (P.H.V.-Koshi). This is consistent with previous research indicating an increase in fibre friction on exposure to corona discharge. Increasing the severity of the corona treatment resulted in a concomitant deterioration in fabric mechanical properties. However for the fluorine treated samples mechanical properties appeared independent of exposure time.

Table 2 below illustrates the effect of these pretreatments on shrinkage properties after 1.3 and 5 5A wash cycles (1×5A equivalent to 10 domestic wash cycles). Both corona and fluorinated treatments restricted fabric shrinkage during washing. In contrast to the corona treatment, where perhaps increased exposure improves wash performances the behaviour of the fluorinated samples appeared independent of treatment time. Whilst it is evident from Table 2 that all pretreatments reduce shrinkage, complete machine washability was not achieved. Samples were therefore treated with two commercial shrinkproofing polymers (of the type usually applied to chlorinated fabric) and their ensuing washing and mechanical properties assessed.

Table 3 below illustrates the effect of Basolan SW (a polyurethane) applied to the various pretreated and control fabrics, on fabric shrinkage. Table 4 below indicates the implication of this treatment for fabric mechanical properties At the applied levels Basolan SW renders all pretreated fabrics shrink resistant. However, bending and shear properties and overall fabric stiffness increase severely.

The shrinkage results of Basolan MW (an amino polysiloxane) applied at two concentrations are given in Table 5 below while Table 6 below indicates the implication of this treatment on fabric mechanical properties (at the higher application level). At the lower application levels, the fluorinated fabrics perform slightly better than equivalent corona pretreated fabrics. At higher application levels both corona and fluorinated samples demonstrate excellent wash performance. Only the chlorinated fabric (and control) exhibit shrinkage. The mechanical properties of these samples were excellent.

Thus it can be concluded that:

Fluorination can be used as an alternative to both corona discharge and chlorination as a preparatory treatment for wool.

Fluorine treatment inhibits fabric shrinkage during washing.

Complete machine washability can be achieved by the application of a polymer (at low levels) with no impairment of fabric handle.

Given the short time for which fabric has to be resident in the fluorine-containing gas, continuous treatment of a fabric is possible in an economic manner.

Investigations indicate that the described procedures improve the dyeability, printability and mechanical processing characteristics of the fabric.

A test was conducted to establish the printability of fabric treated in accordance with the present invention Fluorination of wool fabric results in improved wettability and therefore improved printing. Test showed that the wettability of fluorinated wool fabric vastly improved with the reduction in wetting time from over 60 minutes for conventional chlorinated fabrics to 2 seconds for fabric treated according to the present invention. Wool fabric was printed using a range of commercial dyes following the manufacturer's recommended procedures and the results are shown in Table 7. The colour yield, K/S, for fluorinated wool is comparable to chlorinated wool and an obvious improvement on untreated wool.

Table 8 shows that fluorination improves whiteness of the fabric before and a steaming of the printed fabric in comparison to chlorinated wool. In pastel shades the brightness/whiteness of the uncoloured areas provides better colour contrast.

Figure 2:
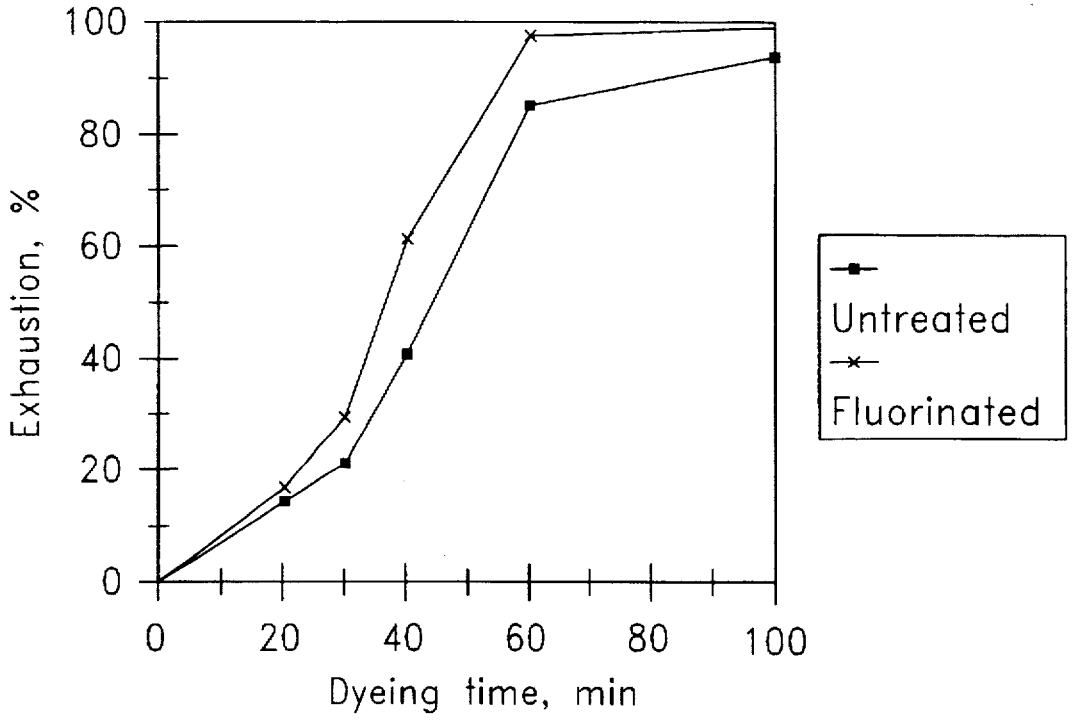
Figure 3:
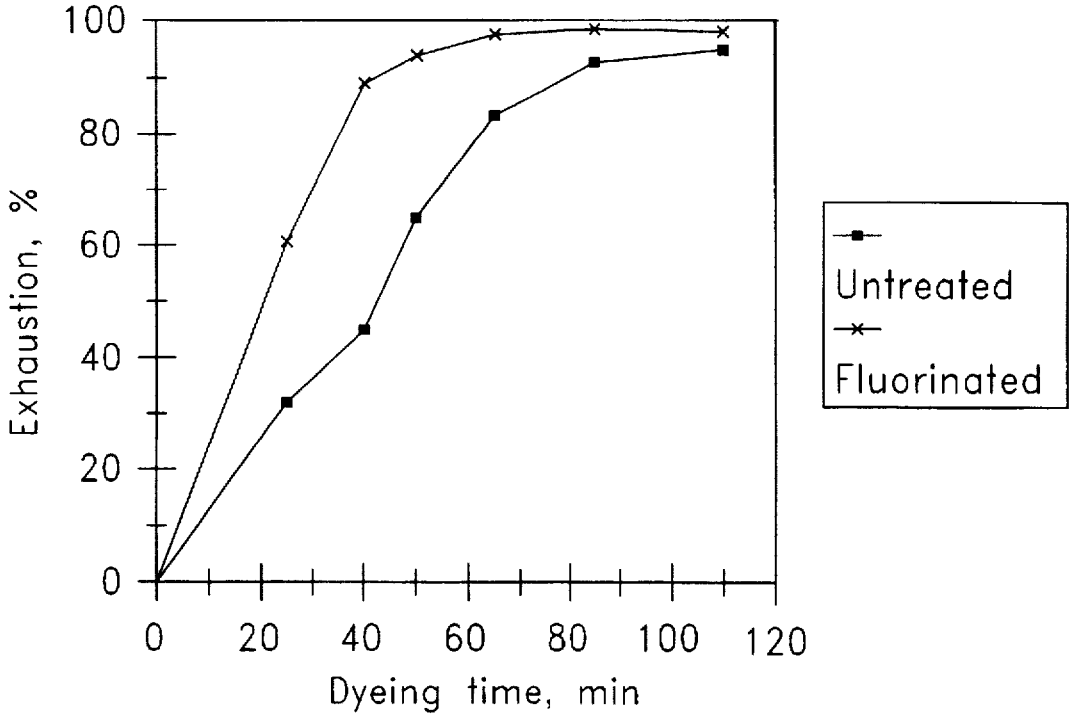
Figure 4:
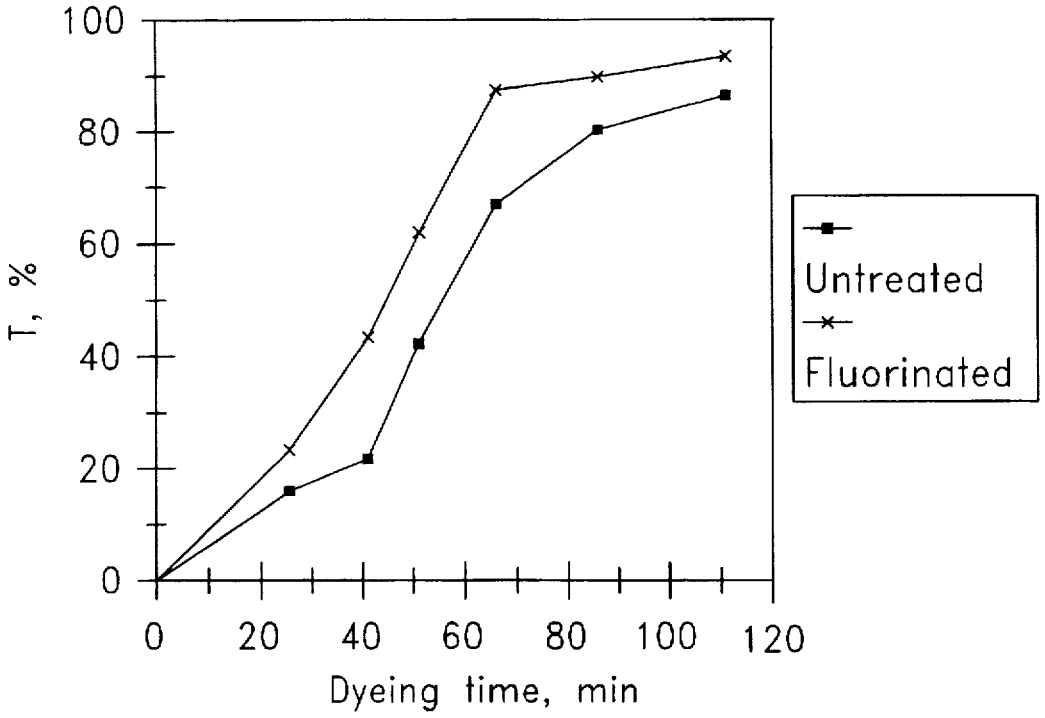
FIG. 4 is a graph of total dye fixation efficiency against dyeing time for Lanasol Blue 3G dye on wool fabric untreated and treated according to the present invention.

In dyeing tests it was established that modifying the surface of the wool fibre, through gaseous fluorination, improved the levelness of the final dyeing over the untreated wool. FIGS. 1,2 3 show the comparative rate of exhaustion for a range of dyes on untreated and fluorinated wool, the dyeing procedure as recommended by dye manufacturers. It will be seen that the rate of exhaustion is greatly improved.

FIG. shows that the level of dye fixation on fluorinated wool is greater than that on untreated wool. This has the advantages that the rate of fading of the fabric and the environmental damage caused by the washed off dye are both reduced.

Figure 5:
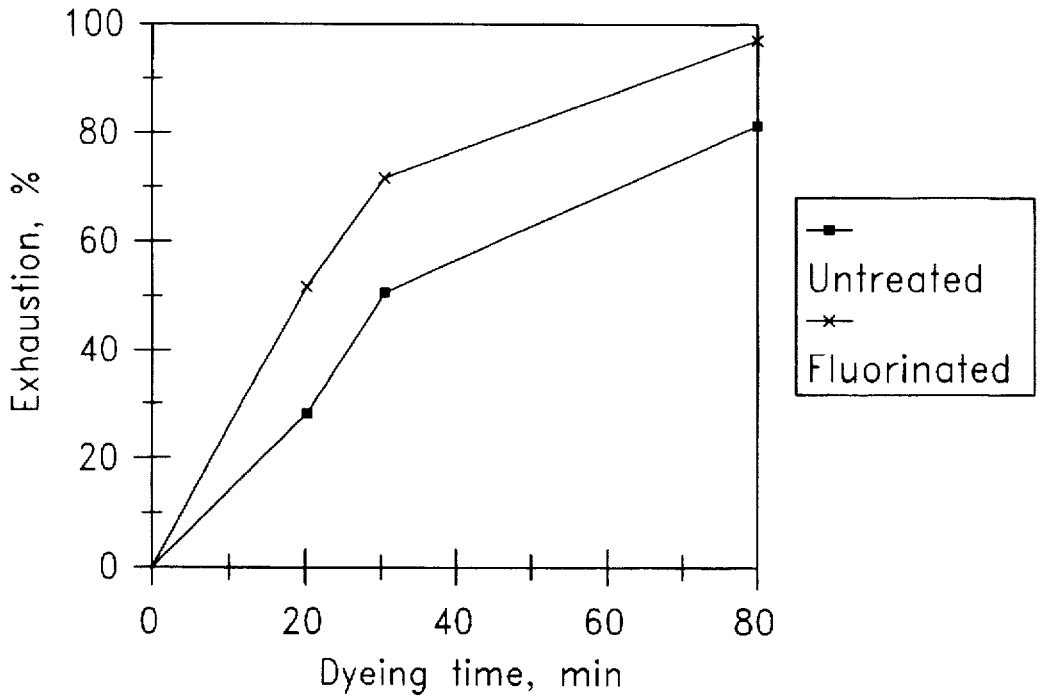
FIG. 5 is a graph of dye exhaustion against dyeing time for Sandolan Milling Blue N-BL dye on wool fabric untreated and treated according to the present invention.

FIG. 5 shows the results of further tests performed to evaluate the effect of fluorination on lower temperature dyeing at 80°–850° C. It was found again that the rate of exhaustion and levelness were much improved for the pretreated wool.

TABLE 1 the effect of fabric pretreatment on mechanical properties

| | SHEAR | | | BENDING | | |
|---|---|---|---|---|---|---|
| SAMPLE | G | 2HG | 2HG5 | B | 2HB | KOSHI |
| Std non pretreated | 0.32 | 0.31 | 0.47 | 0.11 | 0.04 | 3.90 |
| Low Fluorination | 0.44 | 1.46 | 2.06 | 0.12 | 0.08 | 4.43 |
| Low/Medium Fluorination | 0.46 | 1.58 | 2.22 | 0.13 | 0.08 | 4.52 |
| Medium Fluorination | 0.46 | 1.63 | 2.18 | 0.13 | 0.09 | 4.42 |
| High Fluorination | 0.44 | 1.41 | 2.13 | 0.13 | 0.09 | 4.50 |
| 650 Wmin/m$^2$ | 0.34 | 0.88 | 1.24 | 0.12 | 0.06 | 3.86 |
| 960 Wmin/m$^2$ | 0.40 | 1.26 | 1.75 | 0.12 | 0.07 | 4.17 |
| 1280 Wmin/m$^2$ | 0.45 | 1.52 | 2.06 | 0.12 | 0.08 | 4.23 |
| Chlorinated | 0.31 | 0.63 | 0.79 | 0.10 | 0.06 | 2.70 |

TABLE 2

The effect of fabric pretreatment on fabric shrinkage

| SAMPLE | % SHRINKAGE (no of wash cycles) 1 | 3 | 5 |
|---|---|---|---|
| Std non pretreated | 18 | 46 | 61 |
| Low Fluorination | 6 | 11 | 14 |
| Low/Medium Fluorination | 5 | 9 | 14 |
| Medium Fluorination | 5 | 9 | 15 |
| High Fluorination | 6 | 11 | 15 |
| 640 Wmin/m$^2$ | 9 | 16 | 24 |
| 960 Wmin/m$^2$ | 9 | 17 | 24 |
| 1280 Wmin/m$^2$ | 5 | 15 | 20 |
| Chlorinated | 10 | 26 | 37 |

TABLE 3

Influence of Basolan SW on Fabric Shrinkage

| SAMPLE | % owf | % SHRINKAGE (no of wash cycles) 1 | 3 | 5 | 7 |
|---|---|---|---|---|---|
| Std non pretreated | 2.5 | 1 | 3 | 12 | 32 |
| Low Fluorination | 2.6 | 0 | 0 | 0 | 0 |
| Low/Medium Fluorination | 2.8 | 0 | 1 | 1 | 1 |
| Medium Fluorination | 2.5 | 0 | 1 | 1 | 1 |
| High Fluorination | 2.8 | 0 | 0 | 0 | 0 |
| 640 Wmin/m$^2$ | 2.2 | 0 | 1 | 0 | 1 |
| 960 Wmin/m$^2$ | 2.2 | 0 | 0 | 0 | 0 |
| 1280 Wmin/m$^2$ | 2.3 | 0 | 0 | 0 | 0 |
| Chlorinated | 2.1 | 0 | 1 | 1 | 2 |

TABLE 4

Influence of Basolan SW on fabric mechanical properties

| SAMPLE | % owf | SHEAR G | 2HG | 2HG5 | BENDING B | 2HB | KOSHI |
|---|---|---|---|---|---|---|---|
| Std non pretreated | 2.5 | 0.55 | 0.75 | 0.98 | 0.19 | 0.09 | 5.16 |
| Low Fluorination | 2.6 | 0.59 | 0.61 | 1.38 | 0.68 | 0.13 | 8.20 |
| Low/Medium Fluorination | 2.8 | 0.62 | 0.68 | 1.46 | 0.51 | 0.16 | 7.41 |
| Medium Fluorination | 2.5 | 0.82 | 0.88 | 1.96 | 0.20 | 0.11 | 6.37 |
| High Fluorination | 2.8 | 0.64 | 0.79 | 1.48 | 0.44 | 0.13 | 8.13 |
| 640 Wmin/m$^2$ | 2.2 | 0.86 | 1.34 | 1.91 | 0.26 | 0.12 | 6.85 |
| 960 Wmin/m$^2$ | 2.2 | 0.65 | 0.92 | 1.44 | 0.28 | 0.11 | 6.76 |
| 1280 Wmin/m$^2$ | 2.3 | 0.84 | 1.49 | 1.94 | 0.26 | 0.13 | 6.78 |
| Chlorinated | 2.1 | 0.55 | 0.86 | 1.17 | 0.29 | 0.13 | 6.26 |

TABLE 5

Influence of Basolan MW on Fabric Shrinkage

| SAMPLE | % owf | % SHRINKAGE (no of wash cycles) 1 | 3 | 5 | 7 |
|---|---|---|---|---|---|
| Std non pretreated | 1.3 | 8 | 27 | 42 | — |
| | 3.6 | 1 | 11 | 27 | 40 |
| Low Fluorination Level | 2.0 | 1 | 3 | 13 | — |
| | 3.0 | 0 | 0 | 1 | 2 |
| Low/Medium Fluorination | 1.4 | 1 | 10 | 22 | — |
| | 3.3 | 0 | 1 | 1 | 1 |

TABLE 5-continued

Influence of Basolan MW on Fabric Shrinkage

| SAMPLE | % owf | % SHRINKAGE (no of wash cycles) 1 | 3 | 5 | 7 |
|---|---|---|---|---|---|
| Medium Fluorination | 1.4 | 0 | 6 | 17 | — |
| | 2.7 | 1 | 0 | 0 | 0 |
| High Fluorination | 1.0 | 0 | 6 | 18 | — |
| | 3.2 | 0 | 0 | 0 | 0 |
| 640 Wmin/m$^2$ | 1.3 | 1 | 14 | 26 | — |
| | 3.0 | 0 | 0 | 1 | 0 |
| 960 Wmin/m$^2$ | 1.4 | 5 | 20 | 35 | — |
| | 3.0 | 0 | 0 | 1 | 0 |
| 1280 Wmin/m$^2$ | 1.4 | 1 | 6 | 21 | — |
| | 3.1 | 0 | 1 | 2 | 3 |
| Chlorinated | 1.4 | 5 | 21 | 37 | — |
| | 2.7 | 1 | 9 | 16 | 28 |

TABLE 6

Influence of Basolan MW on fabric mechanical properties

| SAMPLE | % owf | SHEAR G | 2HG | 2HG5 | BENDING B | 2HB | KOSHI |
|---|---|---|---|---|---|---|---|
| Std non pretreated | 3.6 | 0.36 | 0.28 | 0.47 | 0.12 | 0.05 | 3.76 |
| Low Fluorination | 3.0 | 0.38 | 0.30 | 0.48 | 0.12 | 0.04 | 3.72 |
| Low/Medium Fluorination | 3.3 | 0.38 | 0.31 | 0.47 | 0.12 | 0.04 | 4.14 |
| Medium Fluorination | 2.7 | 0.36 | 0.29 | 0.41 | 0.11 | 0.04 | 3.84 |
| High Fluorination | 3.2 | 0.36 | 0.23 | 0.41 | 0.11 | 0.03 | 4.02 |
| 640 Wmin/m$^2$ | 3.0 | 0.37 | 0.28 | 0.45 | 0.12 | 0.04 | 3.97 |
| 960 Wmin/m$^2$ | 3.0 | 0.36 | 0.30 | 0.46 | 0.11 | 0.04 | 3.72 |
| 1280 Wmin/m$^2$ | 3.1 | 0.48 | 0.45 | 0.74 | 0.11 | 0.04 | 4.22 |
| Chlorinated | 2.7 | 0.33 | 0.38 | 0.49 | 0.12 | 0.06 | 3.40 |

TABLE 7

Colour yields (K/S) of untreated and pretreated wool prints

| Dyes | K/S U | C | F |
|---|---|---|---|
| Milling | | | |
| 30 g/kg Polar Red RLS (160%) | 15.0 | 21.1 | 21.8 |
| 20 g/kg Polar Yellow 4G (160%) | 12.2 | 20.5 | 17.3 |
| 20 g/kg Erionyl Red 3G | 10.7 | 28.6 | 26.6 |
| 30 g/kg Lanaset Blue 5G | 20.8 | 28.5 | 28.2 |
| Premetallised | | | |
| 15 g g/kg Lanacron Red S-G | 15.0 | 28.0 | 22.3 |
| 15 g/kg Irgalan Yellow 2GL KWL | 15.8 | 24.7 | 24.7 |
| 15 g/kg Irgalan Navy Blue B KWL | 15.7 | 29.3 | 22.1 |
| Reactive | | | |
| 20 g/kg Lanasol Yellow 4G | 8.3 | 20.9 | 17.8 |
| 20 g/kg Lanasol Red 6G | 13.2 | 24.2 | 21.9 |
| 20 g/kg Lanasol Blue 3G | 16.4 | 27.3 | 24.3 |

U Untreated wool
C Chlorinated wool
F Fluorinated wool

TABLE 8

| Yellowness pretreated wool fabrics | | |
|---|---|---|
| | B.P. | A.S.W. |
| Untreated | 22.8 | 25.3 |
| Chlorinated | 27.8 | 32.1 |
| Fluorinated | 25.6 | 27.2 |

B.P. Before printing
A.S.W. After streaming and washing

We claim:

1. A method for treating a fabric comprising fibres of keratin to impart shrink-resistance to the fabric comprising passing the fabric continuously through a chamber containing an atmosphere of 10% or less fluorine gas by volume at a rate such that the residence time of the fabric within the chamber is 60 seconds or less.

2. A method according to claim 1, wherein the residence time is less than 12 seconds.

3. A method according to claim 2, wherein the residence time is less than 6 seconds.

4. A method according to claim 3, wherein the residence time is 4 seconds.

5. A method according to claim 1, wherein the atmosphere contains 3% fluorine by volume.

6. A method according to claim 1, wherein the atmosphere is a mixture of nitrogen and fluorine gases.

7. A method according to claim 1, wherein a polymer coating is applied to the fabric after treatment by fluorine gas.

8. A method according to claim 7, wherein the polymer coating is an amino polysiloxane.

* * * * *

UNITED STATES PATENT AND TRADEMARK OFFICE

CERTIFICATE OF CORRECTION

PATENT NO. : 5,780,107

DATED : July 14, 1998

INVENTOR(S) : Christopher M. Carr et al.

It is certified that error appears in the above-identified patent and that said Letters Patent is hereby corrected as shown below:

In column 1, line 3, please change "prosing" to --pre-treating--.
In column 1, line 5, please change "fabrics" to --fabric--.
In column 1, line 11, please change "th" to --the--.
In column 1, line 15, please insert --1.-- before "Scale masking or surface coating".
In column 1, line 16, please insert --2--before "Chemical or enzymic".
In column 1, line 17, please insert --3.-- before "Formation of inter-fibre bonds".
In column 2, line 54, please change "o.w.f. on weight of fabric" to --% o.w.f.-% on weight of fabric--.
In column 3, line 6, please change "huidity" to --humidity--.
In column 4, line 31, please change "and a steaming" to --and after steaming--.
In column 4, line 38, please insert the word --and-- between the numbers "2" and "3".
In column 4, line 41, please insert the number --4-- after the word "FIG."
In column 4, TABLE 1, please change "650 Wmin/$m^2$" to --640 Wmin/$m^2$--.
In column 7, TABLE 8, please change "A.S.W. After streaming and washing" to --A.S.W. After steaming and washing--.

Signed and Sealed this

Seventeenth Day of August, 1999

*Attest:*

Q. TODD DICKINSON

*Attesting Officer*

*Acting Commissioner of Patents and Trademarks*